United States Patent [19]

Aubert

[11] Patent Number: 5,033,145

[45] Date of Patent: Jul. 23, 1991

[54] BRIDGING SYSTEM FOR ALLOWING VEHICLES TO CLEAR BREACHES

[75] Inventor: Henri M. M. Aubert, La Seyne sur Mer, France

[73] Assignee: Constructions Industrielles de la Mediterranee, France

[21] Appl. No.: 548,295

[22] Filed: Jul. 5, 1990

[30] Foreign Application Priority Data

Jul. 6, 1989 [FR] France ..... 89 09133

[51] Int. Cl.[5] ..... E01D 1/00

[52] U.S. Cl. ..... 14/1; 14/2.4

[58] Field of Search ..... 14/1, 2.4, 3, 7, 13–15, 14/17

[56] References Cited

U.S. PATENT DOCUMENTS

| | | | |
|---|---|---|---|
| 3,305,885 | 2/1967 | Vaillant et al. | 14/2.4 |
| 3,323,157 | 6/1967 | Vaugoyeau | 14/2.4 |
| 3,820,181 | 6/1974 | Wagner et al. | 14/2.4 |
| 4,521,932 | 6/1985 | Parramore | 14/2.4 |
| 4,602,399 | 7/1986 | Jenkins | 14/2.4 |
| 4,621,385 | 11/1986 | Gillois | 14/2.4 |
| 4,649,587 | 3/1987 | McFarlane et al. | 14/2.4 |
| 4,662,020 | 5/1987 | Wilkerson | 14/2.4 |
| 4,698,866 | 10/1987 | Kano | 14/2.4 X |
| 4,723,333 | 2/1988 | Williams | 14/2.4 |
| 4,853,998 | 8/1989 | Bernard et al. | 14/2.4 |
| 4,920,595 | 5/1990 | Füssinger et al. | 14/2.4 |

FOREIGN PATENT DOCUMENTS

| | | | |
|---|---|---|---|
| 1680207 | 12/1971 | Fed. Rep. of Germany . | |
| 1938940 | 4/1979 | Fed. Rep. of Germany | 14/2.4 |
| 1945676 | 3/1971 | Fed. Rep. of Germany . | |
| 1963393 | 7/1971 | Fed. Rep. of Germany . | |
| 2641257 | 12/1977 | Fed. Rep. of Germany . | |
| 3320633 | 12/1984 | Fed. Rep. of Germany | 14/2.4 |
| 1339046 | 8/1963 | France | 14/2.4 |
| 2577863 | 8/1986 | France | 14/2.4 |
| 2597129 | 10/1987 | France | 14/2.4 |
| 1416228 | 12/1975 | United Kingdom | 14/2.4 |
| 2164377 | 3/1986 | United Kingdom | 14/2.4 |
| 2186615 | 8/1987 | United Kingdom | 14/2.4 |

*Primary Examiner*—Ramon S. Britts
*Assistant Examiner*—Gay Ann Spahn
*Attorney, Agent, or Firm*—Ostrolenk, Faber, Gerb & Soffen

[57] ABSTRACT

A bridging system for clearing a breach comprising at least two identical beams rigidly connectable endwise and including each one at least one supporting structure having treadways at the upper portion and two noses pivoted to both ends, respectively, of the supporting structure so that each nose assumes a position folded back onto the structure and a position extended in prolongation of the latter.

25 Claims, 9 Drawing Sheets

2d
8
9
4c
11a
11
10
7b
7
7d
7c
7a
12
2a
2e
22a
23a
2a1
14a
6b
14
19
F2
18
24
21
20
23
22
16
17
F1
5
12a

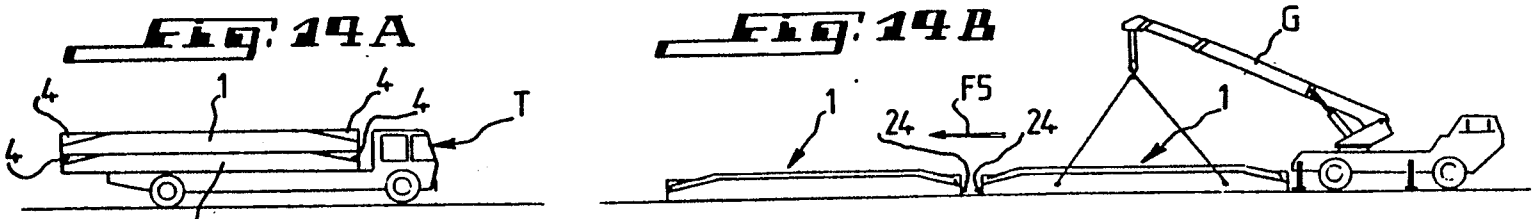
FIG. 14A
FIG. 14B
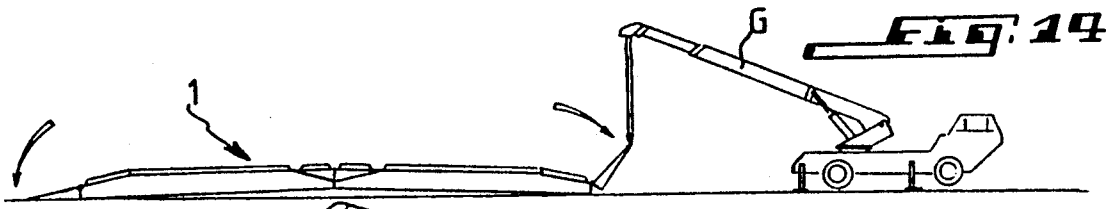
FIG. 14C
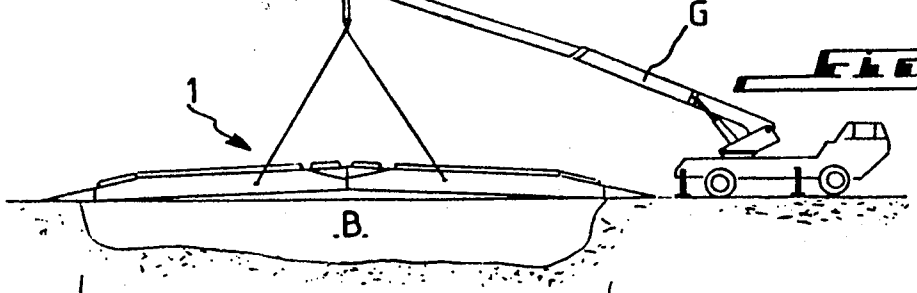
FIG. 14D
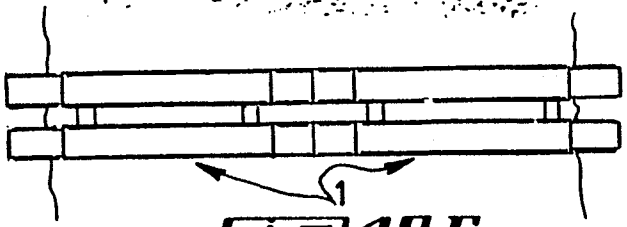
FIG. 14E
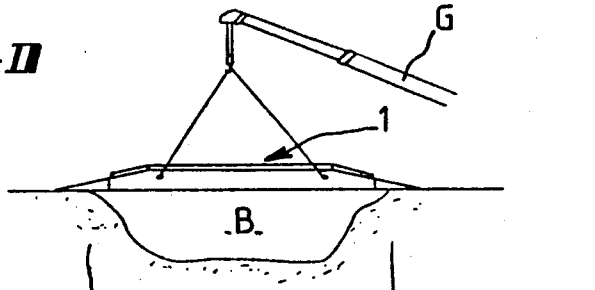
FIG. 15A
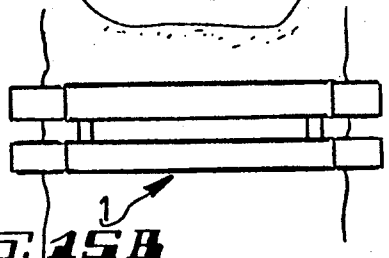
FIG. 15B

BRIDGING SYSTEM FOR ALLOWING VEHICLES TO CLEAR BREACHES

The present invention relates to a bridging system intended to allow in particular military vehicles to clear, to pass or to cross in particular breaches and like gaps or ditches.

The bridging systems used heretofore comprise a monolithic beam or joist of short bearing, span or outreach for clearing or passing a relatively small breach or a monolithic beam of greater bearing distance for clearing or passing relatively great breaches or gaps.

Such systems suffer from the inconvenience of requiring at least two transport vehicles namely one having at least one beam with a short bearing and the other one with at least one beam of larger bearing or span.

The object of the present invention is to remove the aforesaid drawback by providing a bridging system intended to allow in particular military vehicles to clear or pass in particular breaches or gaps and characterized in that it comprises at least two identical beam units adapted to be rigidly coupled endwise, each beam unit comprising at least one strong supporting structure with a treadway or track at the upper portion; two noses, jibs or bills pivotally mounted onto both ends, respectively, of the supporting structure for pivotal motion about a transverse pivoting axis so that each nose or jib assumes either a position folded down or back onto the supporting structure or a position extended in prolongation of the supporting structure to which the nose or jib is rigidly secured by a locking device; a beam when used to cover a breach or gap having its two end noses or jibs extended to form access noses rigidly fixed to the supporting structure and bearing onto both opposite edges, respectively, of the breach or gap.

According to a characterizing feature of the invention the device for locking each nose to the supporting structure comprises at least one lock consisting of first male or latch-bolt means and second female or bolt-clasp means made fast with the nose or jib and with the supporting structure and located substantially at a same distance from and on either side of the horizontal plane containing the axis of pivoting motion in relation to the supporting structure so that the first means may be locked into the second means in the extended position of the nose or jib.

According to another characterizing feature of the invention two beams are rigidly coupled endwise at their front faces respectively defined each one by a nose folded back onto the corresponding supporting structure by two locking devices made fast with both beams, respectively, at their respective ends, each locking device consisting of the aforesaid locking device with at least one lock, the first and second beams of the lock of the locking device at the end of one of the two beams engaging the second and first beams, respectively, of the lock of the locking device at the end of the other beam upon the coupling of both beams.

The first and second means of the lock at one end of a beam are made fast with one nose and with the supporting structure, respectively, and the first and second means of the lock at the opposite end of the beam are made fast with the supporting structure and with the other noze, respectively.

Advantageously the first means of a lock is a transverse locking axis or pin and the second means of this lock is a locking hook, the locking pin and hook projecting from a same side of the corresponding front face of a beam.

Preferably each beam comprises at one of its ends a positioning foot and at its other end a positioning opening, the positioning foot of one beam engaging the positioning opening of one other beam upon the coupling of both beams for their mutual positionings, the positioning foot-opening assembly taking up the shearing stresses resulting from the passage or travelling of vehicles on the tradeways or tracks of both coupled beams.

According to still a further characterizing feature of the invention each nose exhibits a general pyramidal shape with a rectangular cross-section both opposite faces of which are intended to be used as treadways or tracks in the folded back and extended positions, respectively, of the nose which is pivoted about the aforesaid pivoting axis with a transverse side of the rectangular base of the nose.

According to still another characterizing feature of the invention each nose comprises two side walls forming wheel guides in the position of the nose folded back onto the supporting structure and retractable in the extended position of the nose.

Each side wall forming a wheel guide is freely slidable relatively in parallel relation to the corresponding side face of the pyramidal nose so as to assume the retracted position when the nose is extended and a stationary or fixed working or operative position when the nose is folded back onto the supporting structure.

Advantageously each aforesaid side wall is bearing through gravity or its own weight onto a subjacent or underlying side wall made fast with the supporting structure and forming a wheel guide in the extended position of the nose.

The invention will be better understood and further objects, characterizing features, details and advantages thereof will appear more clearly as the following explanatory description proceeds with reference to the accompanying diagrammatic drawings given by way of non limiting example only and illustrating one presently preferred specific embodiment of the invention and wherein:

FIGS. 14A to 14E illustrate the fashion according to which two beams are couples endwise to form a beam with a great span or outreach; and FIG. 15A et 15B show the laying down of one single beam over a breach or gap to be cleared.

Figure 9:
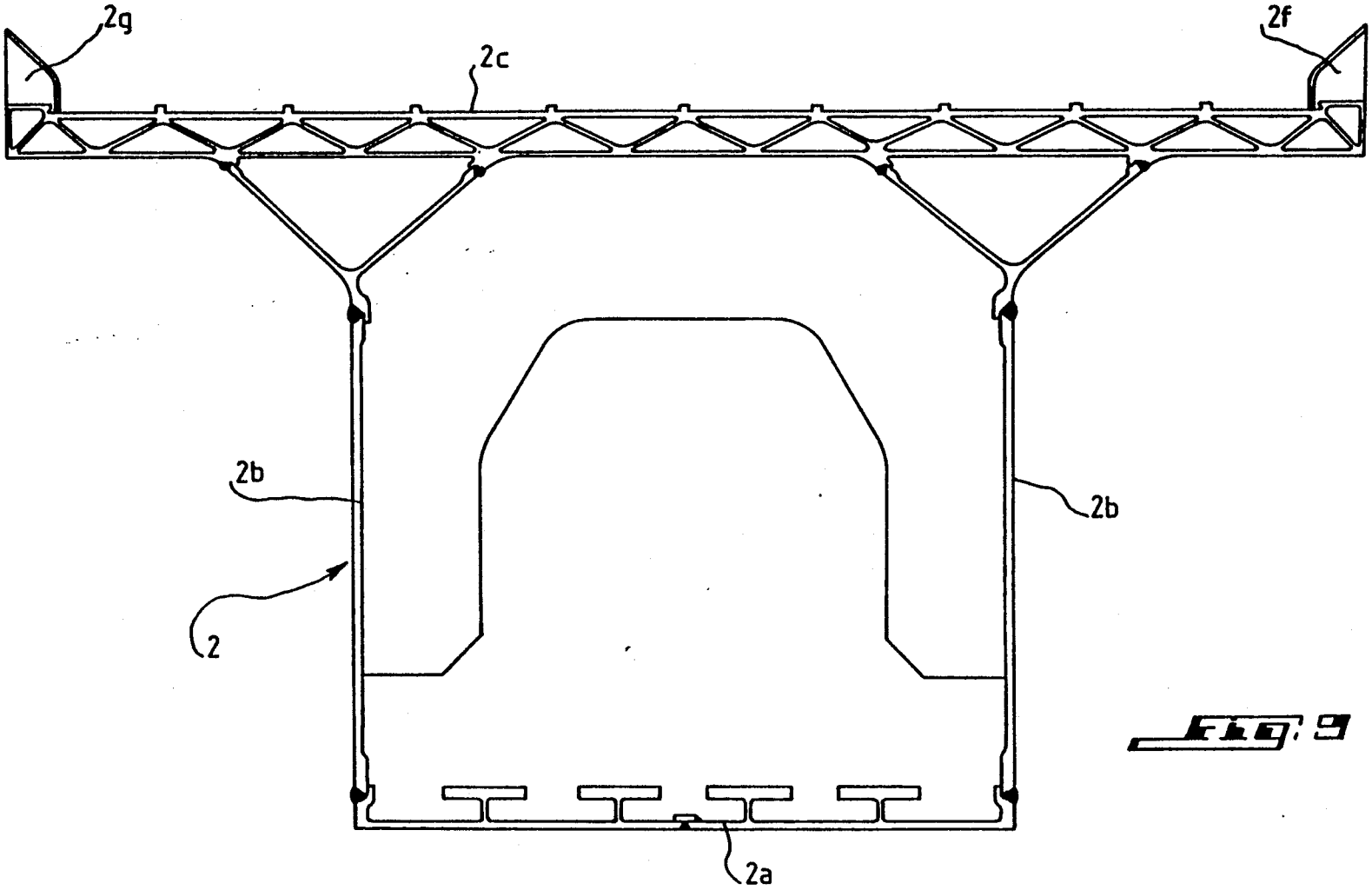
FIG. 9 is a view in section taken upon the line IX—IX of FIG. 4.
Figure 10:
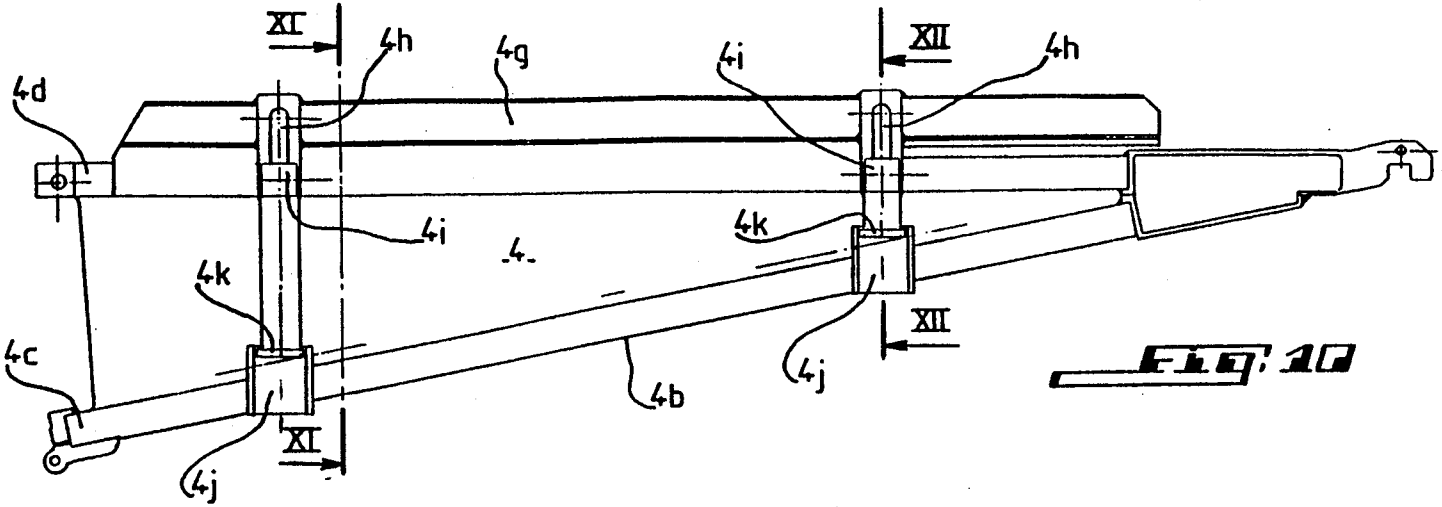
FIG. 10 is a top view of a nose alone.
Figure 11:
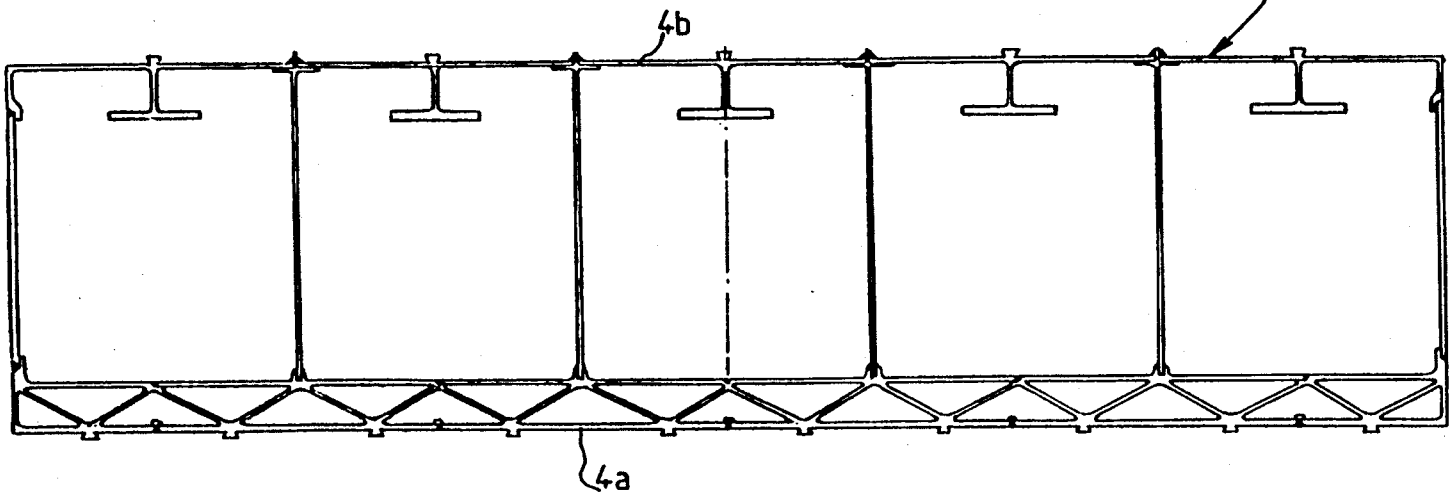
FIG. 11 is a view in section taken upon the line XI—XI of FIG. 10.

Referring to the Figures the reference numeral 1 designates a beam according to the invention intended to be used for clearing a breach or gap of relatively small width. The beam 1 comprises two like strong supporting structures 2 extending lengthways and connected to each other by several rigid transverse connecting arms 3 only one of which is shown and made fast with each supporting structure 2 for instance through welding. Each supporting structure 2 comprises a lower portion 2*a* forming a bottom member with which are made fast two uprights 2*b* supporting an upper portion forming a treadway or track consisting of a horizontal central portion 2*c* and of two end portions 2*d* made fast with both ends, respectively, of the central portion 2*c* in downward extension thereof. It appears in particular from FIG. 9 that each supporting structure 2 is made from a mechano-welded metal framework, the central and end treadway portions 2*c* and 2*d* consisting of two parallel plates with a reinforcing triangulation truss or bracing therebetween. In order to avoid encumbering the Figures only one end portion 2*d* has been shown.

Figure 4:
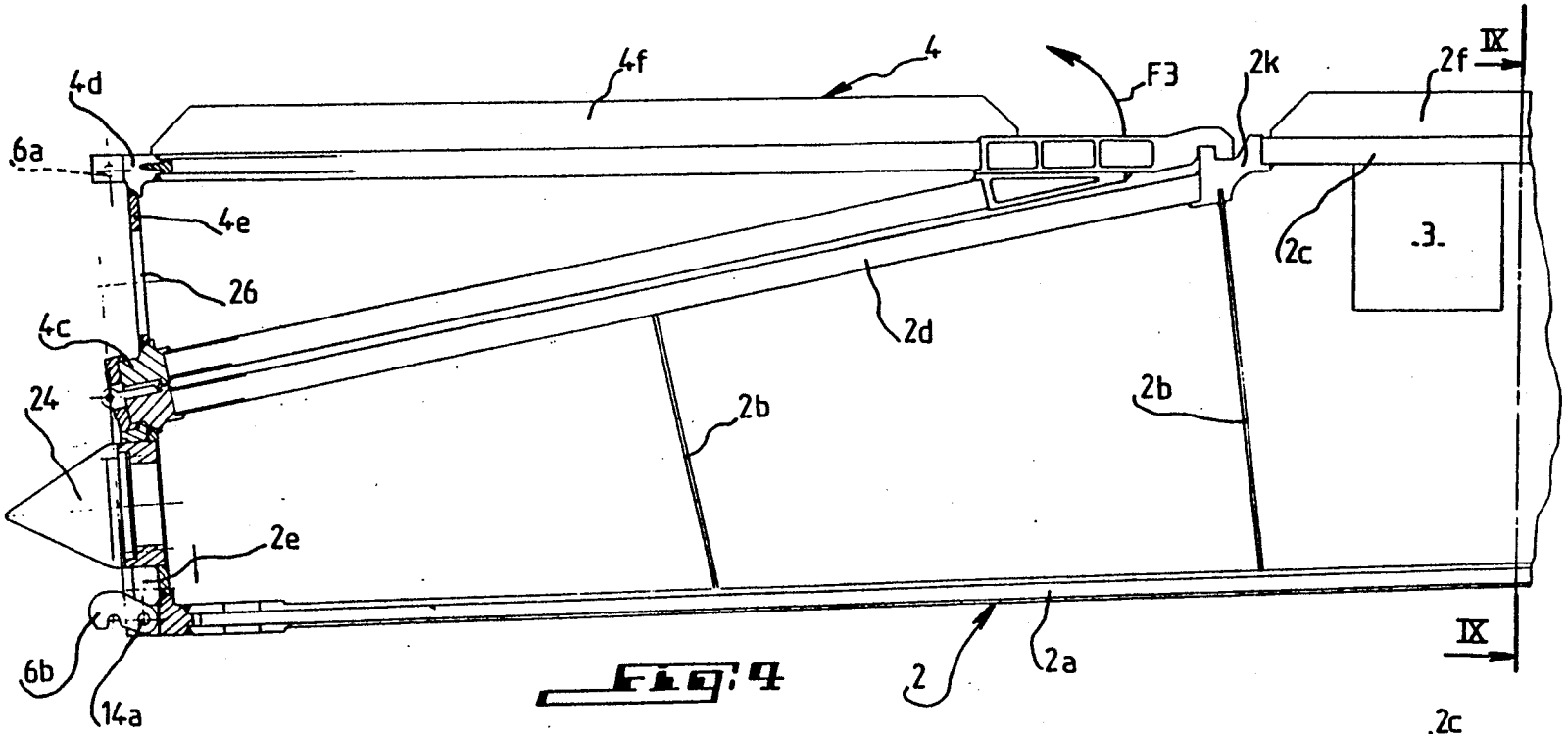
FIG. 4 is a partial view in section taken upon the line IV—IV of FIG. 1.
Figure 5:
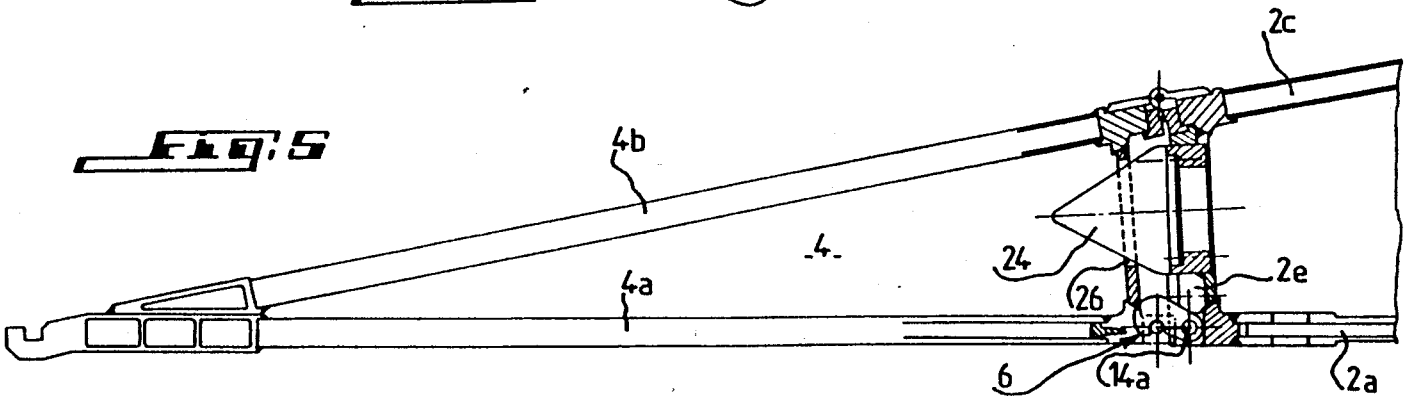
FIG. 5 shows a nose or jib in positions extended and locked to the corresponding supporting structure of one beam.

Two identical noses or jibs 4 only one of which is shown in detail are mounted onto both ends, respectively, of a supporting structure 2 for pivoting motion about a transverse pivot axis 5 so that each nose 4 assumes either a position folded down or back onto the corresponding end portion 2*d* of the supporting structure 2 as shown in FIG. 4 or a position extended or unfolded in prolongation of the supporting structure 2 to which the nose 4 is rigidly fixed by a locking device 6 as shown on FIG. 5. Each nose 4 exhibits a general pyramidal shape with a rectangular cross-section both opposite faces 4*a* and 4*b* of which are intended to be used as treadways or tracks in the folded back and extended or unfolded positions, respectively, of the nose which is pivoted about the pivot axis 5 with one transverse side 4*c* of the rectangular basis of the nose 4. Thus in the position of the nose 4 folded back onto the end portion 2*d* the face 4*a* of the nose 4 is in substantially horizontal extension of the treadway or track of the central portion 2*c* and in the extended or unfolded position of the nose 4 the face 4*b* thereof is in extension of the treadway or track of the end portion 2*d*.

To the extent where both supporting structures 2 with their associated end noses 4 are identical only one unit consisting of the supporting structure 2 and of the associated noses 4 will be described.

The transverse pivot axis 5 is shaped as a pivot hinge consisting of several spaced yoke or clevis portions 7 with both parallel legs 7*a* of each portion 7 made fast by fastening screws 8 with the end of the end portion 2*d* of the structure 2. A central portion 7*b* located between two legs 7*a* of a yoke or clevis portion 7 is made fast with the transverse side 4*c* of the nose 4 by fastening screws 9 and pivotally mounted between both legs 7*a* for swinging motion about the pivot axis 5 consisting of a transverse pivot pin 7*c* made fast with the central portion 7*d* and which may rotate with its two free ends within two slightly elongated bores 7*d* machined to extend through both legs 7*a*.

Figure 2:
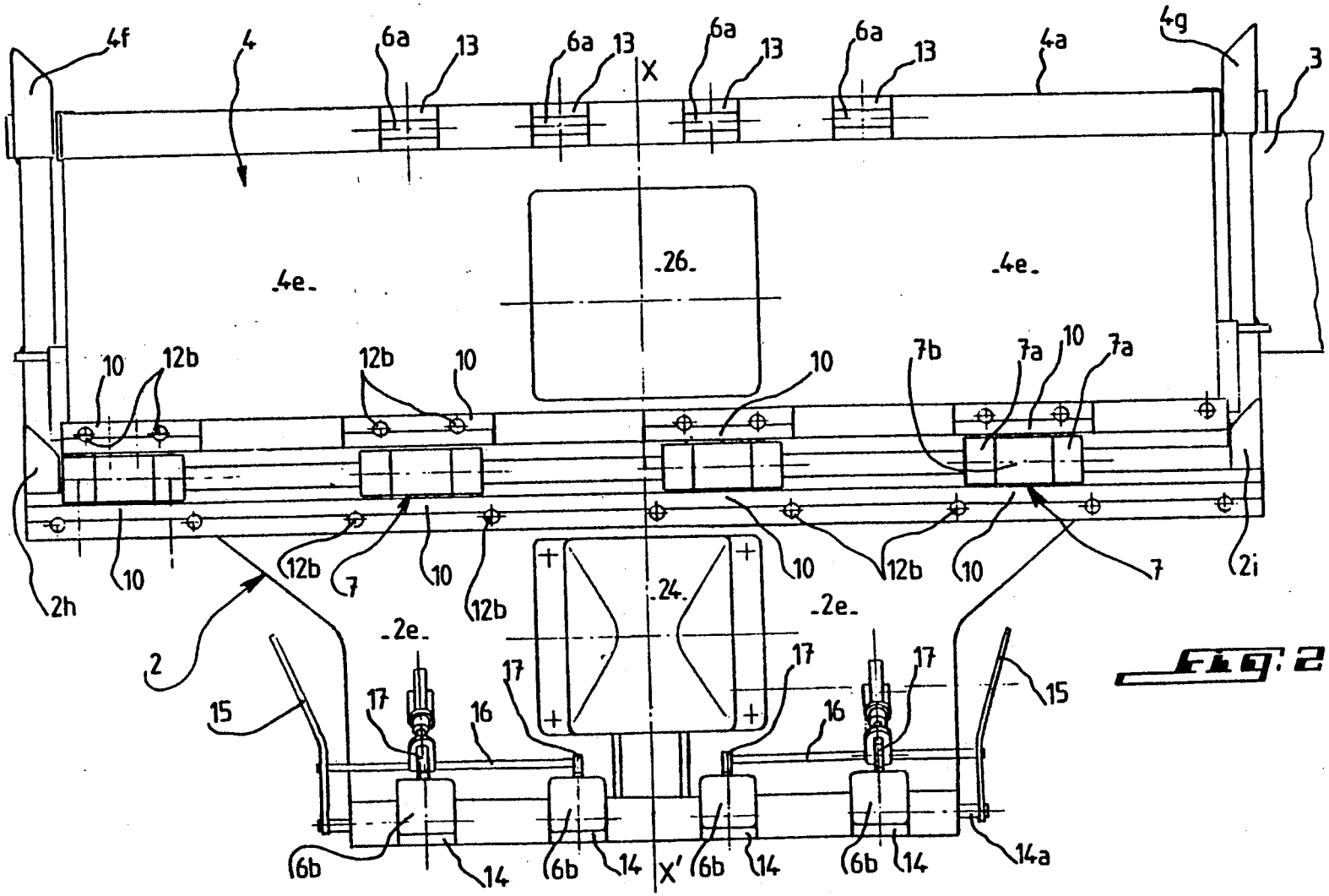
FIG. 2 is an enlarged view of another beam of FIG. 1.
Figure 3:
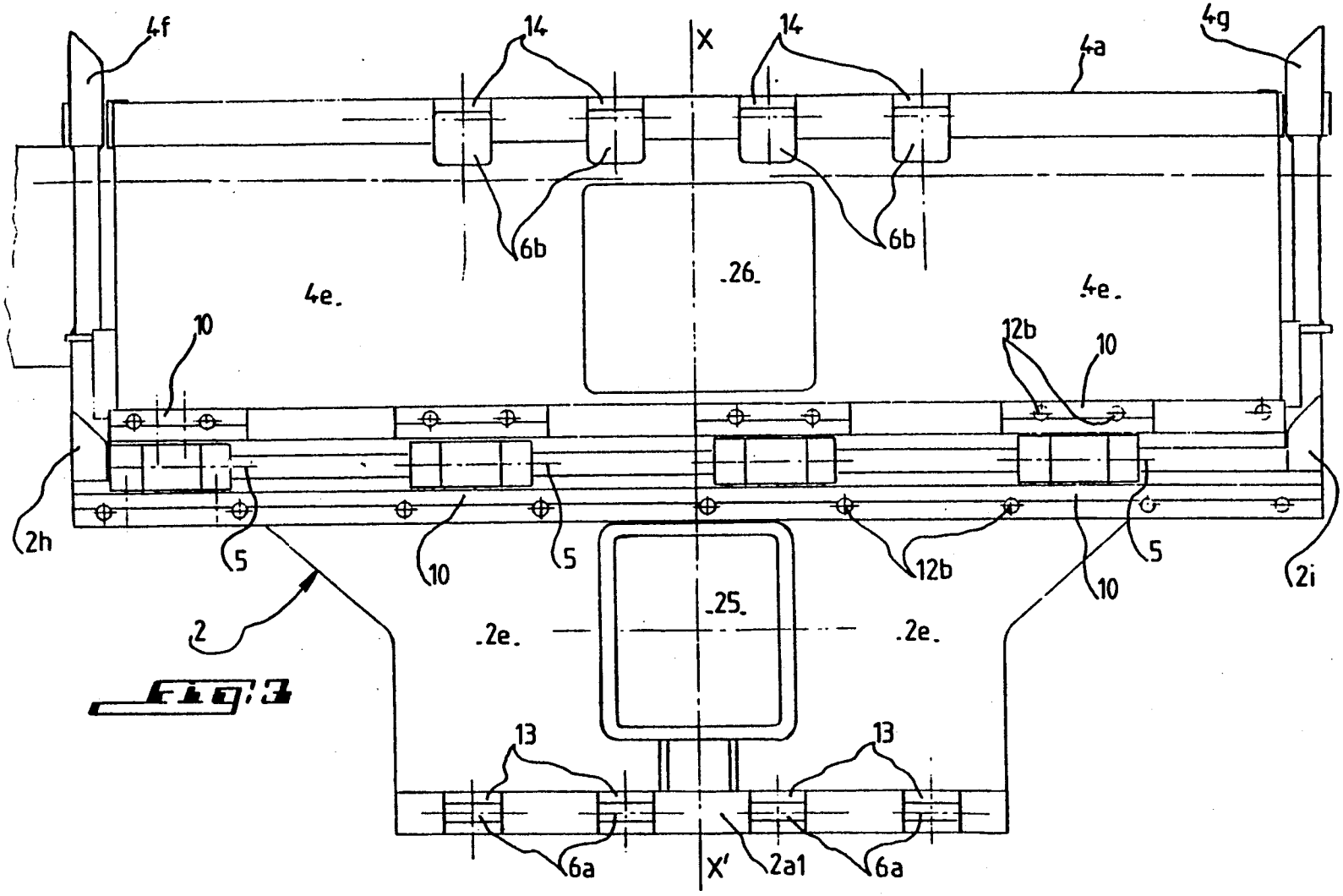
FIG. 3 is also an enlarged view of the other part of the beam of FIG. 1.

Bearing faces 10 are arranged on either side of the transverse axis 5 in symmetric relation thereto and above and below the yoke portions 7 in the folded back position of the nose 4. These bearing faces 10 are machined onto top or bottom parts or blocks 11 made fast with the ends of the end portion 2*d* and of the transverse side 4*c*, respectively, of the nose 4 by fastening screws 12 embedded into the blocks 11 at right angles to the horizontal plane containing the transverse axis 5 and screwed underneath the legs 7*a* of the portions 7 for the bottom blocks and on the other legs 7*a* for the top blocks 11; right-angled portions 11*a* bearing once the screws 12 have have been tightened onto corresponding shoulders of the ends of the portions 2*d* of the structure 2 and of the transverse side 4*c* of the nose 4. The blocks 11 are moreover secured to the ends of the portion 2*d* and of the transverse side 4*c* by fastening screws 12*a* screwed into corresponding tapped holes of these ends perpendicular to the plane of FIG. 2 or of FIG. 3, the passageway holes for the screws 12*a* through the blocks 11 being designated by the reference numeral 12*b*. When each nose 4 assumes the extended or unfolded position in prolongation of the portion 2*d* to thus serve as an access nose the bearing faces 10 are in abutment with each other so as to relieve the pivot axis 5 from the forces applied thereto in particular when heavy vehicles are passing on the treadway.

Figures 6, 7, 8:
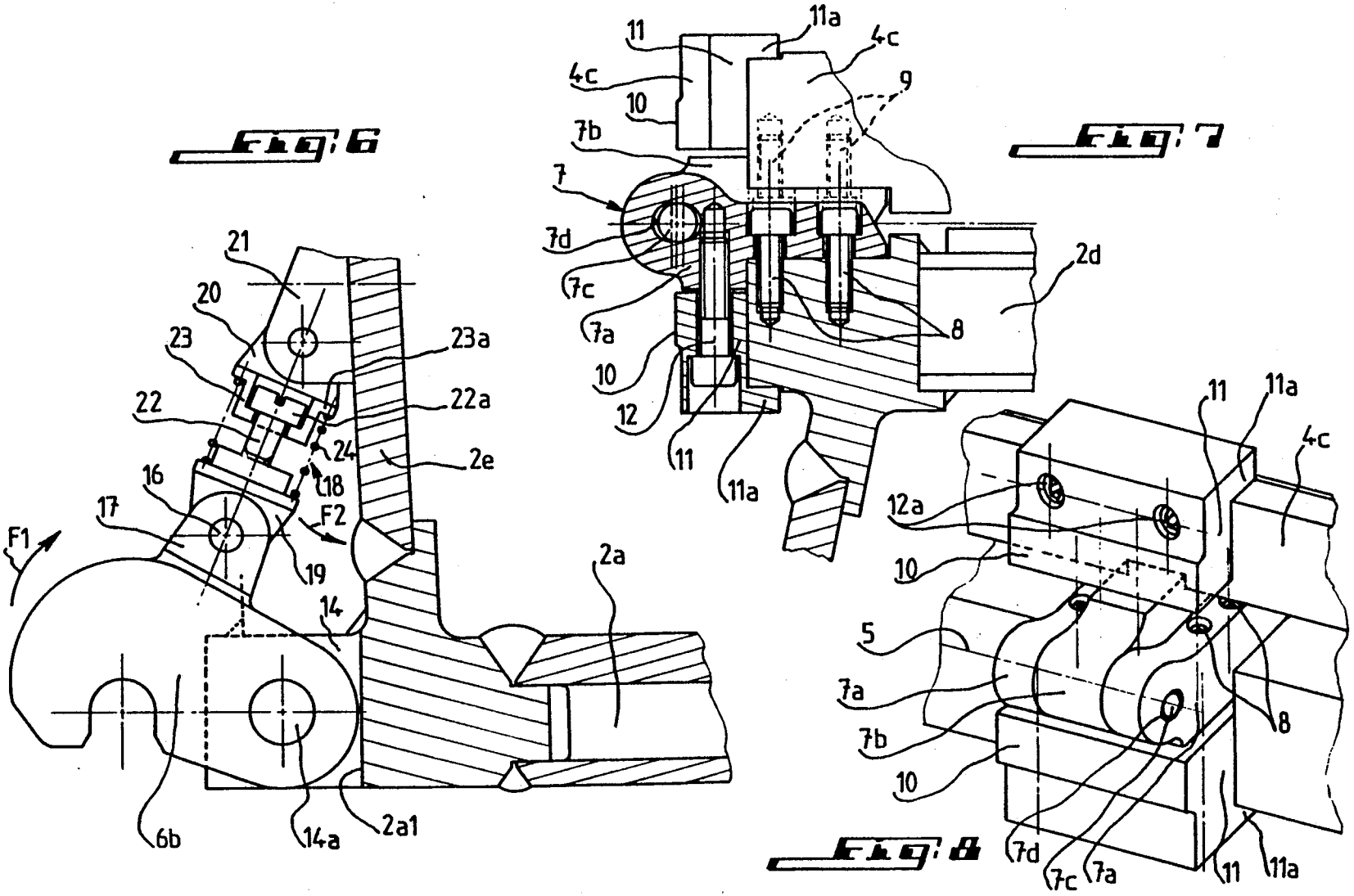
FIG. 6 is a view in section taken upon the line VI—VI of FIG. 1.
FIG. 7 is a view in section taken upon the line VII—VII of FIG. 1.
FIG. 8 is a perspective view of a portion of a nose pivotally conected to the supporting structure of a beam.

The device for locking an extended or unfolded nose 4 to the supporting structure 2 comprises several locks 6 consisting each one of first and second male and female means 6*a*, 6*b* made fast with the nose 4 and with the supporting structure 2, respectively, and located when one nose assumes the folded back position at a same distance from and on either side of the horizontal plane containing the pivot axis 5 of the nose in relation to the supporting structure 2. The first means 6*a* of the locks 6 consist of coaxial transverse locking axes or pins made fast at one end of a unit consisting of a supporting structure 2 and of noses 4 with the upper transverse side 4*d* of one nose 4 opposite to the lower transverse side 4*c* of this nose when looking at the nose 4 in the folded back position and at the opposite end of this unit with the lower portion forming the bottom member 2*a* of the supporting structure 2. More specifically the transverse axes 6*a* are accommodated or housed in U-shaped longitudinal openings 13, respectively, defined in the transverse side 4*d* of the nose 4 so that the axes 6*a* project from the front face 4*e* of the nose 4 defining the rectangular base thereof or in the front face 2*a*1 of the portion 2*a*. The second means of the locks 6 consist of aligned locking hooks 6*b* made fast at the end of one unit consisting of the supporting structure 2 and of the noses 4 with the inner portion forming a bottom member 2*a* of the structure 2 and at the opposite end of this unit with the upper transverse side 4*d* of the associated nose 4. Each hook 6*b* is pivotally mounted in a U-shaped longitudinal yoke-like opening 14 for swinging motion about a transverse axis 14*a* between an unlocked position and a locked position. As shown for four locking hooks 6*b* with four locking axes 6*a*, these hooks are operated two by two through two side levers, respectively, only both levers 15 associated with the lower hooks 6*b* at the end of the unit consisting of a supporting structure 2 and of the nose 4 being shown. Each lever 15 has its end opposite to the operating grip or handle made fast with the pivot axis 14*a* extending through two yoke-like recesses 14 while being made fast with both hooks 6b and is also made fast at an intermediate portion between the operating handle or grip and the end connected to the axis 14a by a connecting rod 16 simultaneously driving both hooks 6b towards their unlocking or locking position by actuating the lever 15. The connecting link 16 extends through two lugs 17 made fast with both hooks 6b, respectively. The yoke-like portions 14 of the lower hooks 6b are projecting from the front face 2e for connection of the end of the portion 2a to the corresponding end where is located the face 2a1 of the lower portion 2a of the structure 2 and on the same side as the upper transverse axes 6a, the faces 2e and 4e forming the front face of a beam. Likewise the upper hooks 6b of the opposite end of the unit consisting of the supporting structure 2 and of the noses 4 are projecting from the front face 4e of other nose 4 on the same side as the lower transverse axes 6a. One of the locking hooks of a pair of hooks 10b actuated concomitantly by a lever 15 is mechanically connected to a device 18 for keeping the pair of hooks 6b either in its locked position or in its unlocked position. This keeping device 18 comprises to end clevisses 19 and 20 pivotally secured to the attachment lug 17 of a hook 6b and to a fastening lug 21, respectively, made fast either with a front face 2e for the lower hooks 6b or with the front face 4e for the upper hooks 6b. Both clevisses 19, 20 are assembled together by a screw 22 screwed into the rear connecting wall of the legs of the clevis 19 and the head 22a of which is kept in bearing engagement with the bottom of a cup-shaped portion 23 by a prestressed compression spring 24 in bearing engagement between the rear face of the clevis 19 and the outer annular flange 23a of the cup 23 made fast with the rear face of the clevis 20. Thus when a lever 15 is operated in the unlocking direction shown by the arrow F1 in FIG. 6 both hooks are pivoting together about the pivot axis 14a and are causing the keeping device 18 to pivot through its pivoting clevisses in the direction shown by the arrow F2 to a position where it maintains both hooks in the unlocking position. This keeping device 18 also allows to maintain a pair of hooks 6b in the locking position shown on FIG. 6. The axes 6a and the locking hooks 6b are arranged in symmetrical relationship with the longitudinal medial plane of a unit consisting of a supporting structure 2 and of noses 4 containing the axis X—X' shown on FIG. 2 or on FIG. 3.

Figure 1:
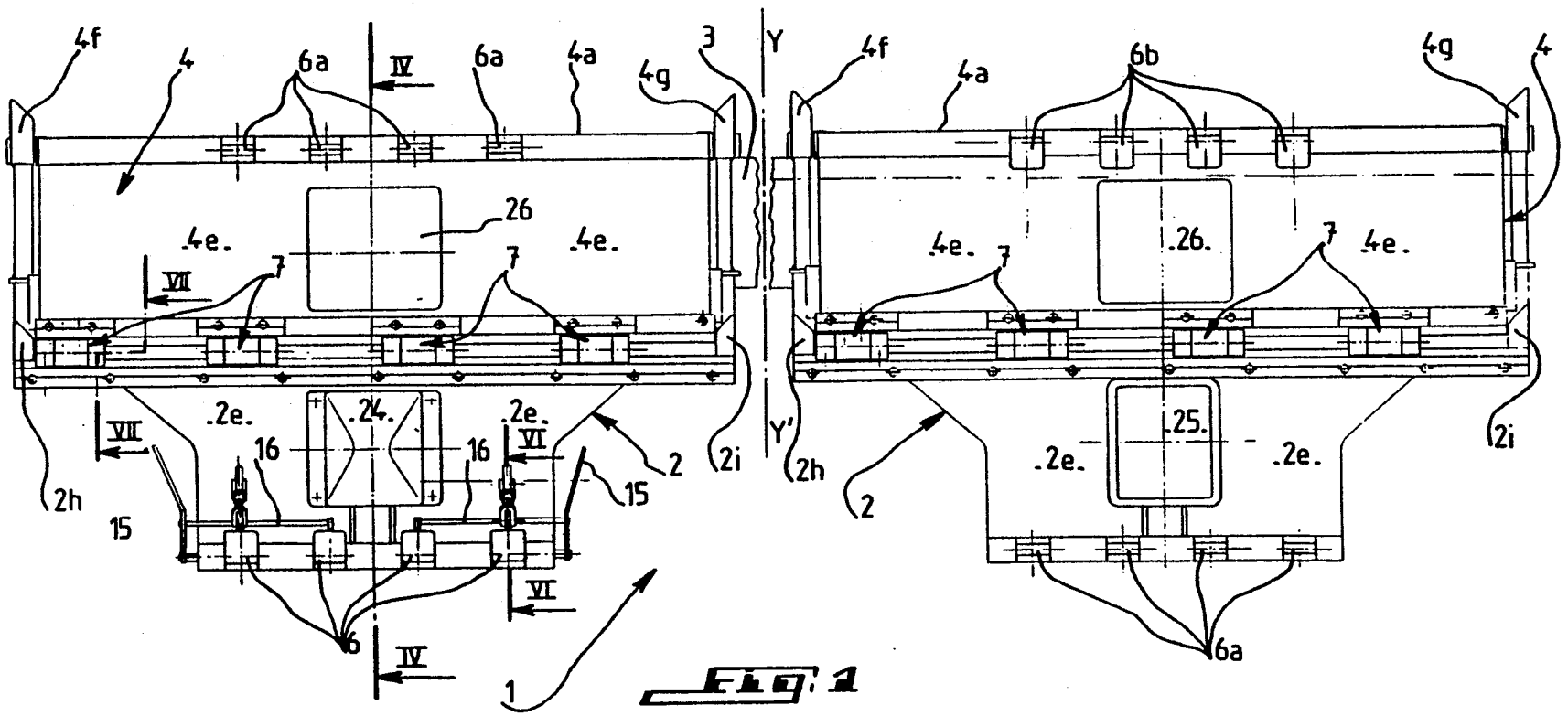
FIG. 1 shows an end view of a beam of a bridging system according to the invention.

It should in addition be pointed out that both supporting structures 2 of a beam 1 are arranged in symmetrical relation to a longitudinal medial plane containing the axis Y—Y' of FIG. 1 so that to the upper locking axes and to the lower locking hooks on a same side of one end of a unit consisting of a supporting structure 2 and of folded-back noses 4 would correspond the upper locking hooks and the lower locking axes, respectively, on the same side of the end opposite to the previous end of the other unit consisting of the supporting structure 2 and of the folded back noses 4. Each supporting structure 2-noses 4 assembly comprises at one of its ends a pyramid-shaped position foot 24 made fast with the front face 2e of the structure 2 and at its opposite end a positioning opening 25 formed through the opposite front face 2e of the structure 2.

Each positioning foot in each positioning opening is so sized that both opposite positioning feet 24 of both supporting structures 2-folded back noses 4 assemblies, respectively, of one beam 1 are engaging two opposite positioning opening 25, respectively, of both supporting structures-folded back noses 4 assemblies of another beam 1 upon the endwise coupling of these two beams for their mutual positionings, the positioning foot 24-opening 25 assembly being adapted to take up the shearing stresses resulting from the passage of heavy vehicules on the treadways of both endwise coupled beams. Each positioning foot 24 and each positioning opening 25 of an assembly are disposed in symmetric relation to the longitudinal medial plane extending through the axis X—X' and located between the pivot axis 5 and the locking hooks 6b and between the axis 5 and the locking axes 6a, respectively.

The front face of one of the folded back noses 4 of each supporting structure 2-noses 4 unit, which front frace is located above one positioning foot 24, comprises an opening 26 of a greater size than that of the positioning foot 24 so as to allow the free passage of the subjacent or underlying positioning foot 24 through the front face 4e upon the extension or unfolding of the nose 4.

Figure 12:
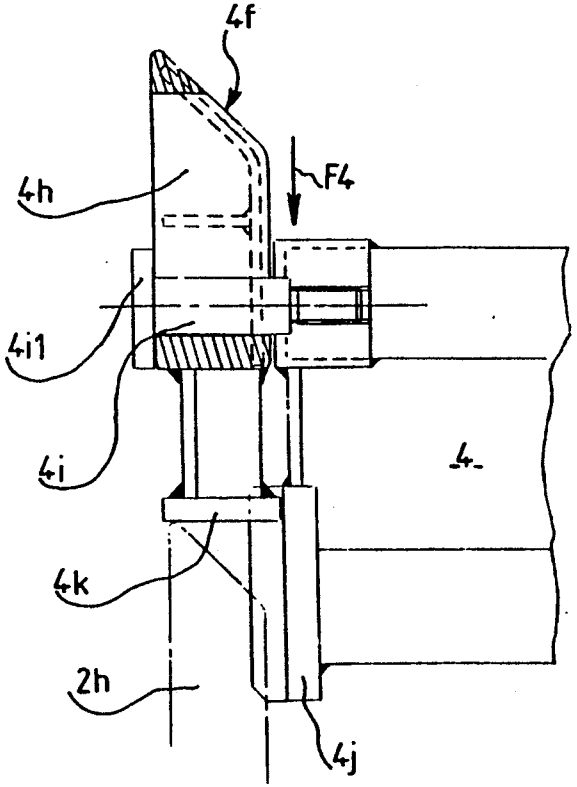
FIG. 12 is a view in section taken upon the line XII—XII of FIG. 10.

Each central treadway portion 2c of a beam 1 comprises two side walls 2f and 2g defining the treadway and forming wheel guides for wheels located on a same side of a vehicle travelling on both parallel treadways of the beam 1. The wheel guide walls 2f and 2g are made fast through welding with the upper portion 2c of each supporting structure 2. Likewise the upper treadway portion 2d of each structure 2 comprises two side walls bounding the treadway and forming wheel guides 2h and 2i. The walls 2h and 2i are made fast also through welding with the upper portion 2d. Each nose 4 comprises two side walls 4f and 4g bounding the treadway 4a of the nose 4 and freely slidable in parallel relation to the side faces of the nose so as to assume a working or operative position projecting above the treadway of the nose at right angles to the treadway when the nose is in the folded back position or a retracted or inoperative position when the nose 4 is extended to be in engagement with the ground, both walls 4f and 4g being retracted until they lie in the laying-down plane of the nose. FIG. 12 shows the structure allowing the wheel guide wall 4f to slide with respect to the side face of a nose 4 for assuming the working and retracting positions, the structure used for the sliding of the wheel guide wall 4g being alike. The side wall 4f shown in the working or operative position comprises several elongated spaced transverse holes 4h at its upper portion through which respectively extend guide axes 41 made fast for instance through screwing with the corresponding side face of the nose 4. Each guide axis 4i comprises a head 4i1 of a size larger than the width of the corresponding elongated hole 4h. Several horizontally U-shaped spaced transverse pieces 4j are secured for instance through welding to the side face of the nose 4 at some distance below the guide axes 4i. A plate 4k protruding outside of the side wall 4f is secured by welding to the lower end of the wall 4f along the latter and projects inwards by forming stud-like members engaging the U-shaped parts 4j, respectively. The plate 4k acts as a stop limiting the downward displacement of the side wall 4f when looking at FIG. 12 while bearing through gravity onto the upper end of the wheel guide side wall 2h. Thus in the operative or working position the guide axis 41 is located at the level of the lower end of the corresponding elongated hole 4h. When one nose 4 is extended in the direction of the arrow F3, the upper end of each guide wheel side wall 4f, 4g of the nose is caused to be in bearing engagement with the ground so as to slidably move in the direction shown by the arrow F4 on FIG. 12 thereby retracting this wall.

Figure 13:
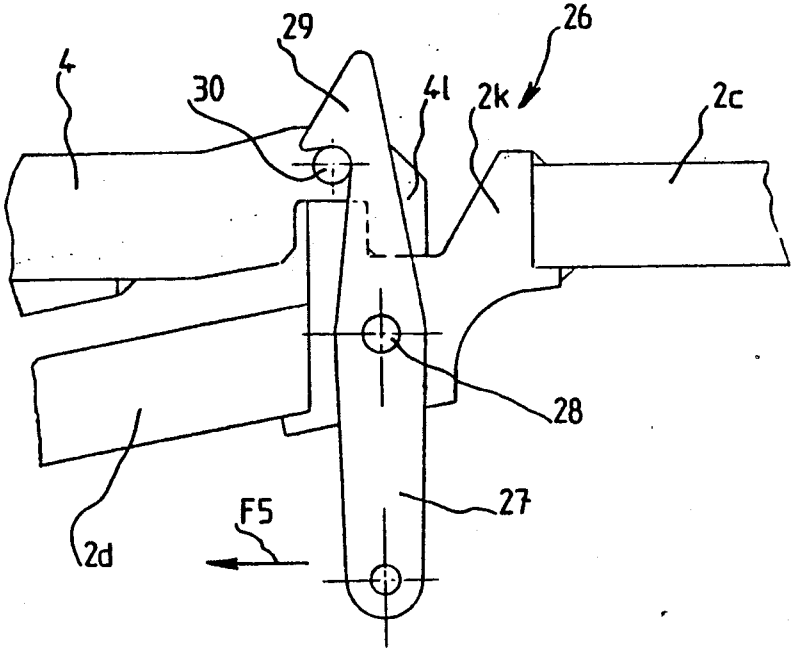
FIG. 13 shows the manner of locking an access nose in the folded back position to the supporting structure of one beam.

Each nose is kept in the folded back position by side locking means 26 only one of which is shown on FIG. 13. The locking means 26 comprises a lever arm 27 pivotally mounted for swinging motion about a central transverse axis 28 made fast with the transverse connecting portion between both treadway portions 2c and 2d of a supporting structure 2. The lever arm 28 terminates at the upper level into a locking hook 29 engageable by a transverse locking axis 30 made fast adjacent to the free hook-like end 41 of the nose 4. This end 41 in the folded back position of the nose 4 is resting in a transverse recess having a mating shape complementary of the junction portion 2k. That end of the lever 27 which is opposite to the locking hook 29 is mechanically connected to a locking and unlocking mechanism (not shown) operated manually or automatically. Such a mechanism may consist of a hand-operated control linkage. In the folded back position of a nose 4 both coaxial locking axes 30 are set or fitted into their two respective locking hooks 29. For unlocking the nose 4 the locking mechanism is actuated so as to pivot the arm 27 about its pivot axis 28 according to the arrow F5 thereby disengaging both hooks 29 from the locking axes 30.

FIGS. 14A and 14E show the handling of both beams and their endwise assembly with a view to form a beam of great span for covering a breach or gap of a large width.

A transport truck T carries near a breach or gap to be covered B at least two overlying identical beams 1 the noses 4 of which are locked in the folded back position. An appliance with a handling gear G takes two beams from the transport truck and lays them down onto the ground so that they be approximately in alignment, one positioning foot 24 of one end of one beam 1 being approximately in front of one positioning opening 25 at the end of the other beam 1 the centering foot 24 of which is also approximately in front of the positioning opening 25 of the first beam 1. The handling crane G axially displaces one of the two beams 1 towards each other as shown by the arrow F5 until both positioning feet 24 engage both positioning openings 25, respectively, with subsequent locking of both adjacent ends of both beams through engagement of the lower and upper locking axes 6a of one beam 1 with the lower and upper locking hooks, respectively, of the other beam and engagement of the lower and upper locking axes 6a of the other beam with the lower and upper locking hooks 6b, respectively, of the first beam. The lower and upper hooks of a beam prior to the engagement of the positioning feet with the respective positioning openings 25 have of course been unlocked by operating the corresponding side levers 15 which are then actuated in the locking direction of the hooks 6b once the positioning feet have engaged the positioning openings 25, respectively. In the endwise assembled position of both beams the adjacent folded back noses provide for a very good mechanical strength in particular at the assembly junction of both beams. It is moreover to be pointed that in order to be sure to profit by the increase in height and therefore in the inertia provided by the folded back position of the noses the latter are not in engagement with each other neither at the hinge portions 7 offset with respect to each other at the assembly junction of both beams nor at the also offset bearing faces 10. The axes 6a and the locking hooks 6b of the locks 6 and the positioning feet 24 and openings 25 are placed so that there is no preferential order for the assembling of both beams. Both pairs of folded back end noses of both coupled beams 1, resctively, are then unlocked from their supporting structure 2 by operating the corresponding arms 27 having the locking hooks 29 in the unlocking direction. The handling crane G is then used to swing both pairs of end noses 4 about their pivot axes 5 so that the locking axes 6a of one nose 4 of one end pair and the lower locking axes 6a of the supporting structure associated with the other access nose 4 of this same end pair respectively engage the lower locking hooks of the supporting structure 2 of the first nose 4 of the pair and the locking hooks 6b of the nose 4 associated with the second supporting structure 2. The engagement of these locking axes 6a is of course effected by folding back the locking hooks 6b from their unlocking position to their locking position. Both pairs of end noses 4 thus extend both parallel treadways, respectively, formed by the portions 2d of both associated supporting structures 2. In the extended or unfolded position of both pairs of end noses 4 on the ground the wheel guide side walls 4f and 4g are in the retracted position. The appliance with the handling crane G at last lays down both coupled beams 1 over the breach or gap B so that both pairs of end noses 4 be in bearing engagement with both opposite edges, respectively, of the breach or gap B.

FIGS. 15A and 15B show a beam 1 laid down over a breach or gap B of relatively small width. This beam has the noses 4 of both end pairs which have been extended and locked to the ends of the beam as described with reference to both pairs of end beams of both coupled beams 1 of FIGS. 14D and 14E and rests with its noses forming access noses onto both opposite edges of the breach or gap B.

The invention has been described with reference to a beam with two units consisting of supporting structures and noses to form two tradways or tracks for the side wheels, respectively, of vehicles but it should be understood that it is also applicable to a beam with one single supporting structure and two end noses to form a tradeway or track with a width allowing the passage of vehicles.

What is claimed is:

1. A bridging system intended to allow in particular military vehicles to clear in particular breaches, wherein the improvement consists in that it comprises at least two identical beams which may be coupled rigidly endwise, each beam comprising at least one strong supporting structure with a treadway at the upper portion; two noses pivotally connected to both ends, respectively, of the supporting structure for swinging motion about a transverse pivot axis so that each nose assumes either a position folded back onto the supporting structure or an extended position in prolongation of the supporting structure to which the nose is rigidly secured by a locking device so that the beam be usable for covering a breach with its two extended end noses forming access noses in bearing engagement with both opposite edges, respectively, of the breach whereas both beams are rigidly coupled endwise at the their respective front faces defined each one by a nose folded back onto the corresponding supporting structure by two locking devices made fast with both beams, respectively, at their respective ends.

2. A system according to claim 1, wherein each locking device providing for the endwise coupling of both aforesaid beams consists of an aforesaid locking device adapted to rigidly secure one nose to the aforesaid supporting structure.

3. A system according to claim 2, wherein the device for locking each nose to the supporting structure comprises at least one lock consisting of first and second male and female means, respectively, made fast with the nose and with the supporting structure and located substantially at the same distance from on either side of the horizontal plane containing the pivot axis of the nose relatively to the supporting structure so that the first means be engageable with the second means in the extended position of the nose.

4. A system according to claim 3, wherein upon the endwise coupling of both beams, the first and second means of the lock of one locking device at the end of one of the two beams engage the second and first means, respectively, of the lock of one locking device at the end of the other beam.

5. A system according to claim 4, wherein said first and second means of the lock at one end of a beam are made fast with one nose and with the supporting structure, respectively, and the first and second means of the lock at the opposite end of the beam are made fast with the supporting structure and the other nose, respectively.

6. A system according to claim 5, wherein said first means of a lock is a transverse locking axis and the second means of this lock is a locking hook, the locking axis and hook projecting from a same side of the corresponding front face of one beam.

7. A system according to claim 6, wherein each locking device comprises several locks arranged in symmetrical relation to the longitudinal medial plan of one beam, the locking axes of the locks, respectively, being in coaxial relationship.

8. A system according to claim 7, wherein each nose is locked in the folded back position by two locking side means comprising each one a pivoting lever arm with a locking hook engageable by a transverse locking axis made fast with the free end of the nose.

9. A system according to claim 8, comprising at least one side lever for operating locking hooks, respectively, of locks at each end of one beam between a locking position and an unlocking position of corresponding locking axes and at least one member for keeping the locking hooks in the locking or unlocking position.

10. A system according to claim 9, wherein the keeping member comprises a prestressed compression spring pivotally mounted at its two ends through the medium of yokes for pivotal connection with the supporting structure or with the associated nose and with a locking hook, respectively.

11. A system according to claim 9, comprising two levers for operating two pairs of locking hooks, respectively, each lever driving a connecting arm of two locking hooks.

12. A system according to claim 1, wherein each beam comprises at one of its ends a positioning foot and at its opposite end a positioning opening, the positioning foot of one beam engaging the corresponding positioning opening of another beam for the purpose of their mutual positionings, the positioning foot-opening assembly taking up the shearing stresses resulting from the passage of vehicles over the treadways of boths endwise coupled beams.

13. A system according to claim 12, wherein said positioning foot has a pyramidal shape.

14. A system according to claim 12, wherein the positioning foot is made fast with the front face of the supporting structure of one beam and the positioning opening is formed in the opposite front face of the supporting structure of the beam.

15. A system according to claim 3, wherein the first means of the locks at the end of one beam are located at the upper level of the front face of the associate nose folded back onto the supporting structure whereas the second means of these locks are located at the lower level of the front face of the supporting structure whereas the second means of the locks at the opposite end of the beam are located at the upper level of the front face of the other associated nose folded back onto the supporting structure and the first means of these locks are located at the lower level of the front face of the supporting structure.

16. A system according to claim 15, wherein said positioning foot is located above the first and second means of the locks depending on the end of the beam with which it is made fast and in symmetrical relation to said longitudinal medial plane.

17. A system according to claim 16, wherein said pivot axis consists of several yoke-shaped portions made fast with the supporting structure and a central portion pivotally mounted between two legs of each yoke and made fast with the nose.

18. A system according to claim 17, wherein the front face of one of the two folded back noses of one beam comprises an opening allowing the free passage through the front face of the underlying positioning foot upon the extension of the nose.

19. A system according to claim 18, wherein each nose exhibits a general pyramidal shape with a rectangular cross-section both opposite faces of which are adapted to serve as treadways in the folded back and extended positions, respectively, of the nose which is pivoted about said pivot axis by one transverse side of the rectangular base of the nose.

20. A system according to claim 19, wherein each nose comprises two side walls forming wheel guides in the position of the nose folded back onto the supporting structure and retractable in the extended position of the nose upon the ground.

21. A system according to claim 20, wherein each wheel guide side wall is freely slidable in parallel relation to the corresponding side face of the associated nose so as to assume the retracted position when the nose is extended and a stationary working position when the nose if folded back onto the supporting structure.

22. A system according to claim 21, wherein in said stationary position each side wall is in bearing engagement through gravity with one underlying side wall made fast with the supporting structure and forming a wheel guide in the extended position of the nose.

23. A system according to claim 22, comprising at least two blocks made fast with the transverse side of one nose and with the end of the supporting structure, respectively, and disposed above and below one aforesaid pivot yoke, respectively, so that both bearing surfaces of both blocks, respectively, are caused to be in abutment in the extended position of the nose in order to take up the forces applied to the pivot axis in particular upon the passage of vehicles over the beam.

24. A system according to claim 23, wherein each beam comprises two identical parallel supporting structures rigidly connected to each other by transverse arms.

25. A system according to claim 24, wherein both supporting structures of one beam are disposed in symmetrical relation to a longitudinal medial plane so that to the first and second means of the locks of one end of a supporting structure and of a folded back nose correspond the second and first means, respectively, of locks of the end on the same side of the other supporting structure and of the associated folded back nose whereas to a positioning foot at the end of one supporting structure corresponds a positioning opening at the end on the same side of the other supporting structure.

* * * * *